United States Patent [19]

Nivens et al.

[11] 4,011,882

[45] Mar. 15, 1977

[54] METHOD FOR TRANSPORTING SWEET AND SOUR HYDROCARBON FLUIDS IN A PIPELINE

[75] Inventors: Robert V. Nivens, Billings, Mont.; Billy J. Williams, Ponca City, Okla.; Irvin Toole, Jr., Humble; Elliott C. Fenton, Houston, both of Tex.

[73] Assignee: Continental Oil Company, Ponca City, Okla.

[22] Filed: Mar. 4, 1976

[21] Appl. No.: 663,947

Related U.S. Application Data

[63] Continuation-in-part of Ser. No. 407,030, Oct. 16, 1973, abandoned.

[52] U.S. Cl. ..... 137/15; 252/8.3; 134/22 C

[51] Int. Cl.[2] ..... B08B 9/00

[58] Field of Search ..... 137/1, 13, 15; 252/8.3, 252/153, 544, 548; 302/66; 134/22 C

[56] References Cited

UNITED STATES PATENTS

| | | | |
|---|---|---|---|
| 3,198,201 | 8/1965 | Every | 137/1 |
| 3,630,212 | 12/1971 | Martin | 137/15 X |
| 3,657,121 | 4/1972 | Gannon | 252/8.3 |
| 3,835,927 | 9/1974 | Alink et al. | 252/8.3 X |

*Primary Examiner*—Alan Cohan

[57] ABSTRACT

A method for minimizing sulfur contamination of refined hydrocarbon fluids transported in a pipeline for the transportation of sweet and sour hydrocarbon fluids by (a) mixing with the sour hydrocarbon fluids from 0 to about 2000 ppm of a corrosion inhibiting additive; (b) transporting the sour hydrocarbon through the pipeline; (c) transporting a sweet hydrocarbon wash solution containing from about 10 to about 2000 ppm of a mixture of light amines and heavy amines, up to about 2000 ppm of a corrosion inhibiting additive, up to about 500 ppm of a surfactant and up to about 1500 ppm of an alkanol containing from 1 to about 6 carbon atoms; and, (d) transporting refined hydrocarbon fluids containing up to about 200 ppm of a corrosion inhibiting additive, an amine having a molecular weight from about 31 to about 500 or mixtures thereof.

14 Claims, No Drawings

METHOD FOR TRANSPORTING SWEET AND SOUR HYDROCARBON FLUIDS IN A PIPELINE

This application is a continuation-in-part of our prior application, U.S. Ser. No. 407,030 of the same title filed Oct. 16, 1973 now abandoned.

FIELD OF THE INVENTION

This invention relates to the transportation of hydrocarbon fluids through pipelines. This invention more particularly relates to a method for transporting sweet hydrocarbon fluids and sour hydrocarbon fluids through a common pipeline. This invention further relates to a method for minimizing sulfur contamination of sweet hydrocarbon fluids transported in a pipeline used for the transportation of sweet and sour hydrocarbon fluids.

PRIOR ART

Heretofore it has not been considered feasible to use pipelines which have been used for the transportation of sour hydrocarbon fluids for the transportation of sweet hydrocarbon fluids. The major difficulty has been that the sweet hydrocarbon fluids are contaminated with sulfur, sulfur compounds, and the like which has been deposited on the interior pipeline walls and the like by the sour hydrocarbon fluids. It clearly is desirable in many areas that pipelines be used for the transportation of both sweet and sour hydrocarbon fluids.

Heretofore it has been known that passing an aqueous acid solution through pipelines which have been used for the transportation of sour hydrocarbon products is effective in removing sulfur, sulfur compounds and the like from the pipeline walls and the like. However, it is necessary in such instances to neutralize the acidic material by passing a suitable aqueous alkaline material such as a sodium bicarbonate solution, a dilute caustic soda solution, or the like through the pipeline. It is also necessary in order to remove the aqueous materials remaining that a drying solution be pumped through the pipeline. Isopropanol has frequently been used as such a drying solution. The line is then ready for service in the transportation of sweet hydrocarbon fluids. Of course, the method described is not suitable wherein the line is used for the transportation of sweet and sour hydrocarbon fluids intermittently but rather is used primarily where a line is being changed from a sour hydrocarbon line to a sweet hydrocarbon line.

As noted hereinbefore, it is desirable in many instances that a single pipeline be used to transport both sweet and sour hydrocarbon fluids without contaminating the sweet hydrocarbon fluids. Accordingly, much time and effort has been devoted to a search for a method whereby sweet and sour hydrocarbon fluids can be transported in a common pipeline without contaminating the sweet hydrocarbon fluid.

OBJECTS OF THE INVENTION

It is an object of the present invention to provide a method whereby sweet hydrocarbon fluids may be transported in a pipeline which has been used for the transportation of sour hydrocarbon fluids. It is a further object of the present invention to provide a method whereby pipelines which have been used for the transportation of sour hydrocarbon fluids may be cleaned.

SUMMARY OF THE INVENTION

It has now been found that the objectives of the present invention are achieved in a method for minimizing sulfur contamination of sweet hydrocarbon fluids transported in a pipeline for the transportation of sweet and sour hydrocarbon fluids by (a) mixing with the hydrocarbon fluids from 0 to about 2000 ppm of a corrosion inhibiting additive; (b) transporting the sour hydrocarbon fluid through the pipeline; thereafter (c) transporting a wash solution through the pipeline; and thereafter (d) transporting sweet hydrocarbon fluids containing up to 200 ppm of a corrosion inhibiting additive, an amine having a molecular weight from about 31 to about 500 or mixtures thereof through the pipeline.

DESCRIPTION OF PREFERRED EMBODIMENTS

The method of the present invention is particularly useful in pipelines which would be useful in the alternate transportation of sweet and sour hydrocarbon fluids if a method for avoiding sulfur contamination of the sweet hydrocarbons are available. Many such pipelines exist, and a method for alternately transporting sweet and sour hydrocarbon fluids without contaminating the sweet hydrocarbon fluids has long been sought by the industry.

The present invention comprises a method for minimizing sulfur contamination of sweet hydrocarbon fluids transported in a pipeline for the transportation of sweet and sour hydrocarbon fluids by (a) mixing with the sour hydrocarbon fluids from 0 to about 2000 ppm of a corrosion inhibiting additive; (b) transporting the sour hydrocarbon through the pipeline; and thereafter (c) transporting a sweet hydrocarbon wash solution containing from about 10 to about 2000 ppm of a mixture of amines consisting essentially of light amines having a molecular weight from 31 to 150 and heavy amines having a molecular weight from 151 to about 500, from 0 to 2000 ppm of a corrosion inhibiting additive; from 0 to 500 ppm of a surfactant and from 0 to 1500 ppm of an alkanol containing from 1 to about 6 carbon atoms in an amount sufficient to provide a wash solution contact time with the interior pipeline surfaces of at least 5 minutes; and thereafter (d) transporting said sweet hydrocarbon fluids containing from 0 to about 200 ppm of a corrosion inhibiting additive, said mixture of amines having a molecular weight from about 31 to 500 or mixtures of said additive and said mixture of amines through said pipeline.

Some suitable sour hydrocarbon fluids are fluids such as crude oils, sour distillates, sour condensates, and the like which contain substantial amounts of sulfur and sulfur compounds such as elemental sulfur, hydrogen sulfide, mercaptans, polysulfides, and the like. Such sulfur is typically corrosive and is undesirable in refined hydrocarbon products. Of course, the quantity of sulfur varies from one crude oil to another, from one condensate to another, and the like. crude oils even though considered sweet contain undesirable amounts of sulfur, sulfur compounds, and the like for transportation in the same pipeline as refined hydrocarbon fluids. In the practice of the present invention, the corrosion inhibiting additive admixed with the sour hydrocarbon product is a material such as, but not limited to, the reaction product formed by the reaction of one molar equivalent of an amine having a molecular weight within a range of from about 150 to about 500 with from about 0.1 to about 0.6 equivalents of an organic hydroxy acid which is relatively heat stable and has an ionization constant of at least $1 \times 10^{-5}$. Such reaction products are shown to be effective as corrosion inhibitors in U.S. Pat. No. 3,061,553 issued Oct. 30, 1962, to Riggs. Some suitable amines include secondary aliphatic and heterocyclic amines. Amines having 2 to about 5 amino groups per molecule are useful. Examples of some useful heterocyclic amines include 1-aminoalkyl-2-alkyl imidazolines such as 1-2 aminoethyl-2-heptadecyl imidazoline and 1-hydroxy propyl-2-pentadecyl imidazoline. Very valuable reaction products may be prepared from secondary aliphatic polyamines, including the alkyl polyalkylene polyamines such as N-dodecylethylenediamine, N-octadecylethylenediamine, N-dodecyltrimethylenediamine, N-pentadecyltrimethylenediamine, N-octadecyltetramethylenediamine, N-octadecyl-1, 3-butanediamine, N-dodecyldiethylene-triamine, and N-octadecyltetra ethylenepentamine, Especially valuable reaction products may be prepared from the polyamine derivatives of natural oils and fats. Such a derivative is the N-alkyltrimethylenediamine material obtained by reacting tallow or tallow acids with trimethylenediamine and hydrogenating the resulting material. This derivative is commercially available from Armour and Company as "DUOMEEN T." Other similar derivatives of trimethylenediamine are "DUOMEEN" "S," "O," and "C" that have been prepared in a similar manner from soyabean oil, oleic acid, and coconut oil, respectively.

About the only requirements in the organic hydroxy acid are that it be reasonably stable to heat and have an ionization constant of at least $1 \times 10^{+5}$. Examples of suitable organic hydroxy acids include: hydroxy benzoic, hydroxy butyric, hydroxy caproic, leuic acid, hydroxy caprylic, hydroxy glutamic, hydroxy glutaric, hydroxy methyl benzoic, hydroxy naphthoic, hydroxy nicotinic, hydroxy phenyl acetic, hydroxy stearic, hydroxy toluic, and hydroxy valeric.

The reaction product of the amine and the critical amount of acid can be prepared by simply mixing the amine and the acid. The reaction product, however, can also be the dehydration product that is obtained by heating the mixture of amine and acid to temperatures at which water is eliminated. This latter type of reaction product is formed only in those instances in which the amine has a reactive hydrogen, i.e., a primary or secondary amine. Since the critical amount of acid used in preparing the reaction product is considerably less than the equivalent weight, the reaction product most probably consists of amine plus a critical amount of salt for those products prepared without elimination of water, amine plus a critical amount of amide where the amine is primary or secondary and water is eliminated, or amine plus a critical amount of imidazoline where the amine is a polyamine having nitrogens with reactive hydrogens separated by alkylene groups of two or three carbon atoms, respectively.

A particularly preferred reaction product is that formed by the reaction of one mole of n-alkyl polyalkylene polyamine having a molecular weight within the range of 150 to 500 and from 2 to about 5 amino groups per molecule with from about 0.1 to about 0.6 equivalents of hydroxy benzoic acid.

As noted hereinbefore, the additive is present in the sour hydrocarbon fluid in an amount equal to 0 to about 2000 ppm. Desirable results have been obtained when from about 20 to about 200 ppm were used and very desirable results have been accomplished wherein about 100 ppm were used. It is, of course, obvious to those skilled in the art that the quantity of the additive required will vary depending upon the amount of sulfur, sulfur compounds, and the like present in the sour hydrocarbon fluid. In general, the additive should be present in an amount sufficient to complex with the corrosive sulfur and sulfur compounds and sufficient to protect the interior surfaces of the pipe from corrosion. Of course, the additive need not be present in all of the sour hydrocarbon products transported, but preferably is present in at least the first portion of sour hydrocarbon shipments.

Many suitable corrosion inhibiting additives complex or react with sulfur compounds and elemental sulfur in the sour hydrocarbon. Many suitable corrosion inhibiting additives also form films on the interior pipeline surfaces, thus further protecting the surfaces from corrosion. The reaction product described above is effective both in complexing or reacting with corrosive sulfur and sulfur compounds and in forming a protective film on the interior pipeline surfaces. Such additives which are both corrosion inhibiting and film forming are preferred.

Parts per million as used herein is parts per million by volume.

The wash solution is sweet hydrocarbon liquid containing at least 25 percent paraffins and having a boiling point at 1 atmosphere below about 1,200° F. Desirably, the hydrocarbon liquid will contain substantially no free sulfur such as hydrogen sulfide, elemental sulfur, mercaptans, and the like. Although minor amounts of free sulfur can be tolerated, such free sulfur in the hydorcarbon liquid requires higher amounts of corrosion inhibiting additives to complex such free sulfur. Some suitable hydrocarbon liquids are propane, butane, gasoline (about 25 to 100 percent paraffinic, more typically about 65 to about 75 percent paraffinic), kerosene (typically more than 75 percent paraffinic), diesel fuel (typically more than 50 percent paraffinic), No. 2 heating oil (typically greater than 50 percent paraffinic, jet fuels such as JP-4 (typically nearly 100 percent paraffinic), and JP-5 (typically more than 75 percent paraffinic), naphtha (typically more than 25 percent paraffinic), desulfurized gas oils (typically more than 60 percent paraffinic), and the like. The wash solution may be selected from any paraffinic sweet hydrocarbon stream, but desirably is selected from those streams which contain at least 25 percent paraffinic materials. Preferred hydrocarbon streams are those which are relatively inexpensive and which are readily added to the sour hydrocarbon stream preceding it or passed to further refining. Of the liquids listed above, gasoline, kerosene, diesel fuel, jet fuels, heating oil, naphtha, and desulfurized gas oil are preferred.

The solution contains from about 10 to about 2000 ppm of a mixture of amines consisting essentially of light amines having a molecular weight from about 31 to 150 and heavy amines having a molecular weight from 151 to about 500. Some suitable light amines are methylamine ethylene diamine, ethylamine, pyridine, ethanol amine, and the like. Methylamine is preferably used with lighter hydrocarbon liquid wash solutions since it is relatively volatile and may require special handling not normally required with heavier hydrocarbon liquid wash solutions. The heavier amines named hereinbefore are also suitable. Of course, the heavier amines are required in larger quantities to achieve the same molar concentrations of amine in the wash solution. The amines are selected from those amines having a molecular weight from about 31 to 150 and from the group having a molecular weight from 51 to about 500. Of the light amines, ethylenediamine has been found highly desirable. Preferably a mixture of amines wherein the molar ratio of light amine to heavy amine varies from about 10:1 to about 1:10 is used. The amine selected is desirably present in an amount slightly in excess, i.e., less than 20 percent in excess, of the amount required to remove the sulfur and sulfur complexes from the interior pipeline surfaces. It has been found that amine concentrations from about 10 to about 500 ppm are effective in most situations and very desirable results have been achieved wherein the amine is present in an amount equal to from about 20 to 200 ppm especially when mixtures of amines as described hereinbefore are used in a molar ratio from about 5:1 to about 1:5. It has been found that such mixtures of amines are much more effective in removing and complexing sulfur, sulfur compounds, and the like than the use of either the light amine or heavy amine alone.

The wash solution also contains from 0 to about 2000 ppm of a corrosion inhibiting additive as described above. Most desirable results have been obtained wherein from about 10 to 200 ppm of the additive was added. It is desirable with each of the components of the wash solution that the minimum amount necessary to effectively remove the sulfur containing components from the pipeline surfaces be used. It is obvious to those skilled in the art that a drastic "overkill" can be used and that grossly increased amounts of the components can be used; however, it is undesirable economically and because of the increased contamination of the refined hydrocarbon fluids with the amines, additive, and the like.

The wash solution desirably contains from 0 to about 500 ppm of a surfactant. The primary requisite in the surfactant is that it be compatible with the additive and the amine, i.e., it must form no undesirable reaction products with the additive or the amine and the like. Some suitable surfactants are organo sulfonates, organo phosphates, organoamino phosphates, or combinations thereof. Preferred surfactants are the organo sulfonates and organoamino phosphates. Particularly preferred surfactants are organoamino phosphates. Of course, as is well known to those skilled in the art, the surfactant may be added to the wash solution in the form of mixtures of surfactant in organic fluids such as kerosene and the like. Some materials which have been particularly effective are DMA-4, marketed by DUPONT Corporation; LUBRIZOL 573-A, marketed by the Lubrizol Corporation; and BETZ WS-58, marketed by the Betz Corporation.

Certain of the heavy amines noted hereinbefore are also effective as surfactants. For instance, amines having the formula:

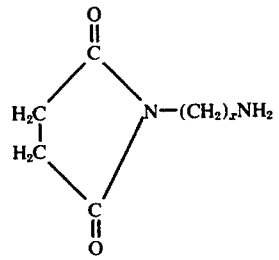

wherein $x$ varies from 4 to 40 are suitable as surfactants.

Desirable results have been obtained when the surfactant is present in an amount equal to from about 25 to about 250 ppm.

The wash solution also contains from 0 to about 1500 ppm of an alkanol containing from 1 to about 6 carbon atoms. It has been found that desirable results are achieved when from about 10 to about 100 ppm alkanol are used. Some suitable alkanols are methanol, ethanol, propanol, isopropanol, butanol, isobutanol, tertiary butanol, hexanol, and the like. Of these isopropanol is preferred.

The sweet hydrocarbon fluid is typically a refinery product stock such as gasoline, kerosene, jet fuel, diesel fuel, heating oil, butane, sweet condensate, and the like. It is very undesirable that such products contain any substantial amounts of corrosive sulfur, i.e., such products desirably achieve at least a 1(b) rating by the copper strip test.[1] It has been found that it is desirable that such sweet hydrocarbon fluids as used in the process of the present invention contain from 0 to around 200 ppm of a corrosion inhibiting additive, an amine mixture as defined hereinbefore, or mixtures of said additive and said amine mixture. Desirable results have been obtained when from 2 to 200 ppm of the additive were present, and most desirable results have been obtained when from about 10 to about 50 ppm were used. It is undesirable that the additive be present in the sweet hydrocarbon fluid in any greater amount than necessary, since in higher concentrations it tends to result in the production of gums and the like. As a result, the use of lower amounts of the additive is preferred.

[1] ASTM Test D130-68

The use of amines, particularly when mixtures of light and heavy amines as described hereinbefore are used, is effective and results in reduced tendencies to form gums and the like. The use of amine mixtures in conjunction with the additive is particularly effective.

It is desirable that the additive, the amine mixture, or mixtures of the additive and the amine mixture be present in the sweet hydrocarbon transported during the 24-hour period following transportation of the wash solution, although in many instances a period of 6 hours or less is sufficient. The amine is desirably a mixture of light and heavy amines as described hereinbefore. The amine mixture is useful in the sweet hydrocarbon in the same proportions as the additive discussed above, and when both the additive and the amine are used, the total of both is within the same range. The proportions may be varied from no amine to no additive, but it is preferred that at least about 2 ppm of the additive be used.

It has been found that the wash solution should be in contact with the interior pipeline surfaces for at least about 1 minute. Desirable results have been obtained wherein the contact time is from about 5 minutes to about 60 minutes, and very desirable results have been obtained when a contact time from about 10 to about 30 minutes was used.

The fluids described typically flow in the sequence sour hydrocarbon fluid, then the wash solution followed by the refined hydrocarbon fluid. It is, of course, possible to utilize intermittent slugs of fluid passing through the pipeline between the three materials described. Such a variation does not modify the effectiveness of applicants' claimed invention so long as the wash solution is positioned between the sour hydrocarbon fluid and the refined hydrocarbon fluid.

One desirable variation comprises the use of "batching pigs" to more discretely separate the sour hydrocarbon fluid from the wash solution and the like. Batching pigs are typically polymeric rubber spheres which are shaped to substantially fill the interior diameter of the pipeline. Accordingly, such devices tend to effectively separate liquid slugs transported through the pipeline, and since they actually scrape the interior pipeline surfaces, they are beneficial in cleaning the surfaces. The use of such batching pigs is well known in the art and need not be discussed further.

While applicants do not wish to be bound by any particular theory, it is believed that certain of the sulfur, sulfur compounds, and the like in the sour hydrocarbon fluid are complexed by the corrosion inhibiting additive, particularly the reaction product described hereinbefore and caused to deposit onto the interior pipeline surfaces. Such a coating tends to result in protecting the pipeline surfaces from attack by corrosive sulfur, sulfur compounds, and the like; however, it is well known that such films tend to release corrosive sulfur and sulfur compounds into trailing sweet hydrocarbons. Such sulfur release is highly undesirable and causes the sweet hydrocarbon fluid to fail marketing specifications. The amines in the wash solution, in conjunction with the other ingredients of the wash solution, are effective in removing from the interior pipeline surfaces the sulfur complexes and compounds produced by the reaction of the additive with the sulfur and sulfur compounds in the sour hydrocarbon fluids. Such materials are removed to a high degree; however, it has been found that upon the passage of the sweet hydrocarbon fluid through such pipelines small amounts of sulfur, sulfur compounds, and the like still tend to be liberated into the refined product. Accordingly, it is preferred that the sweet product contain an effective amount of the additive to insure that corrosive sulfur, sulfur compounds, and the like released from the interior pipeline walls may be complexed and redeposited on the interior pipeline walls or maintained in a complexed noncorrosive form. As is well known to those skilled in the art, the use of materials such as the reaction product described above tends to complex corrosive sulfur compounds into noncorrosive sulfur containing complexes, compounds, and the like.

It has further been found that the method of the present invention is effective is removing sulfur, sulfur compounds, and the like from surfaces so contaminated by a method comprising contacting said surface with a wash solution as described hereinbefore. It is, of course, desirable that the contacting with the wash solution be followed by washing with a sweet hydrocarbon fluid containing up to 200 ppm of a corrosion inhibiting additive, and amine mixture as described hereinbefore, or mixtures of said additive and said amine mixture.

Having thus described the invention, it is noted that many variations and modifications are possible within the scope of the present invention, and it is anticipated that many such variations and modifications may appear obvious and desirable to those skilled in the art upon a review of the foregoing description of preferred embodiments and the following examples.

EXAMPLES

EXAMPLE 1

A 5,000-barrel batch of sour condensate was transported through an 8-inch pipeline. The condensate contained 100 ppm of a reaction product produced by reacting orthohydroxybenzoic acid (25.8 parts by weight) with iso-oleic propylene diamine (74.2 parts by weight) at 290° F for 3 hours. The sour condensate was buffered on each side by JP-4 jet fuel containing 100 ppm of the reaction product. The product transportation sequence was as shown below in Table I.

TABLE I

| Product | Reaction Product PPM | Batch Size, Barrels |
|---|---|---|
| All Products | 20 | 400,000 |
| JP-4 Buffer | 100 | 652 |
| Sour Condensate | 100 | 5,026 |
| JP-4 Buffer | 100 | 333 |
| Regular Pipeline Gasoline* | 100 | 20,822 |
| Regular Pipeline Gasoline* | None | 5,126 |
| Regular Pipeline Gasoline* | 100 | 29,412 |
| Regular Pipeline Gasoline* | None | 54,878 |

*Regular pipeline gasoline containing tetraethyl lead, antioxidant, and metal deactivators as follows:

1 to 2 grams of lead per gallon of gasoline
5 pounds antioxidant per 1,000 barrels of gasoline
0.5 pounds metal deactivator per 1,000 barrels of gasoline The metal deactivator is n,n'-disalicylident-1,2-propanediamine, and the antioxidant is added as a 50 weight percent blend of n,n'-diisopropylparaphenylenediamine in methanol with the antioxidant being present in the gasoline in an amount equal to about 10 ppm. The chemical structure of n,n'-diisopropylparaphenylenediamine is as follows:

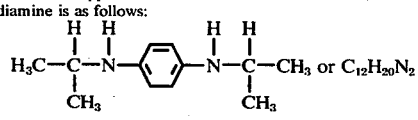

The products following the sour condensate were sampled at numerous points. The sample point distances from starting point are shown in the following table.

TABLE II

| Sample Location | Distance From Start, Miles | Hours From Start |
|---|---|---|
| 1 | 0 | 0 |
| 2 | 4.5 | 1.35 |
| 3 | 44.4 | 13.3 |
| 4 | 71.8 | 27.3 |
| 5 | 112.4 | 37.2 |
| 6 | 156.9 | 47.0 |
| 7 | 193.5 | 58.0 |
| 8 | 244 | 73.0 |

As a result of the sampling, it was observed that after 5 miles of transportation, none of the product showed an undesirable sulfur contamination. After transportation in the pipeline over a distance of about 72 miles and a time period of about 24 hours, it was observed that 20,000 barrels of the trailing product exhibited an undesirable sulfur contamination. After transportation through the pipeline over a distance of about 244 miles during a period of 73 hours, it was observed that about 60,000 barrels exhibited an undesirable sulfur contamination.

An undesirable sulfur contamination is considered as any copper strip test rating less than 1 under ASTM test D130-68 as shown in the edition issued effective Sept. 13, 1968.

It is thus clearly shown that merely admixing the reaction product with both the sour hydrocarbon and the trailing hydrocarbon is ineffective in preventing sulfur contamination of the trailing hydrocarbon product.

EXAMPLE 2

A test was conducted to demonstrate sulfur contamination removal by a wash solution. In this experiment, a 2-inch pipeline test loop ¼ mile long was circulated with sour condensate for 72 hours. The condensate was dumped and followed by a short buffer (unleaded gasoline containing no additives) approximately ½ the length of the test loop (15 minutes of normal operation). The buffer was followed by a wash solution. The wash solution consisted of unleaded gasoline containing an amine, a surface active agent, the reaction product described in Example 1, and isopropyl alcohol in the proportions shown below.

250 ppm Lubrizol 573A
250 ppm reaction product
750 ppm isopropyl alcohol
250 ppm ethylene diamine The unleaded gasoline used was a refinery product ready for pipeline delivery but containing no additives. The solution was circulated for 45 minutes and dumped. Unleaded gasoline containing no additives was thereafter circulated for 48 hours through the test loop. At the end of this time, the gasoline was 1(a) by the ASTM copper strip test. In a similar test conducted without the wash solution, the trailing gasoline failed a copper strip test within 30 minutes of initial circulation and then progressively worsened. It is clearly shown that the use of a wash solution as described hereinbefore is effective in preventing sulfur contamination of trailing sweet products.

EXAMPLE 3

A third test of the transportation of sour liquids in a products pipeline was made using an 8-inch pipeline. The test procedure was essentially as follows:

1. 1,000 barrels of unleaded gasoline containing 200 ppm of the reaction product described in Example 1 was passed through the pipeline followed by
2. 5,000 barrels of sour gas oil containing 50 ppm of the reaction product;
3. 500 barrels of unleaded gasoline containing no reaction product;
4. 2,000 barrels of the wash solution described in Example 2;
5. 45,000 barrels of regular pipeline gasoline as described in Example 1 and containing 100 ppm reaction product and
6. 13,000 barrels of regular pipeline gasoline as described in Example 1 and containing 30 ppm of the reaction product.

The trailing products were sampled at various points along the pipeline as shown in Table III.

TABLE III

| Sample Location | Distance From Start, Miles | Hours From Start |
|---|---|---|
| 1 | 0 | 0 |
| 2 | 4.5 | 1.35 |
| 3 | 44.4 | 13.3 |
| 4 | 71.8 | 27.3 |
| 5 | 112.4 | 37.2 |
| 6 | 156.9 | 47.0 |
| 7 | 193.5 | 58.0 |
| 8 | 244 | 73.0 |

In all cases the trailing product was found to meet ASTM specifications with respect to the copper strip test (i.e., no ratings greater than 1(b) were obtained).

It is thus clearly shown that the use of the wash solution between the sour hydrocarbon fluid and refined hydrocarbon fluid as shown hereinbefore is effective in preventing sulfur contamination of the trailing product.

EXAMPLE 4

It is believed that the reaction product of Example 1 complexes with the sulfur, sulfur compounds, and the like in sour hydrocarbons and that the resulting sulfur-reaction product complex or compound deposits on the interior iron surfaces of the pipeline. Accordingly, it is believed that the removal of the complex or compound from the iron surfaces by the wash solution is primarily responsible for the desirable results in avoiding sulfur contamination of the trailing refined products. In order to demonstrate the effectiveness of various materials in the wash solution, a solution of sour condensate containing from 100 to 120 ppm of the reaction product of Example 1, radioactively labelled with tritium, was added to a bottle of iron filings. The mixture was agitated for a few hours and the condensate solution filtered away from the iron filings. Analysis of the condensate solution indicated 84 percent of the sulfur-reaction product complex had been absorbed on the iron filings. These iron filings were then used to test the effectiveness of various ingredients used in the wash solution. The quantity of labelled sulfur-reaction product complex removed with each clean-up technique was accepted as a measure of the effectiveness of the wash solution ingredients. Thus by using a standard measure of iron filings and wash solutions, it was possible to screen many potential solvents, surfactants, and combinations. It was found that the sulfur-reaction product complex became more difficult to wash from the iron filings each day; therefore, it is necessary that only the results of one day's experimentation be compared to that day's standard. In other words, new controls were run each day. An identical wash procedure was used with all tests shown. Results of this work are recorded in Table IV.

TABLE IV

| Test Series | No. | Wash Solvent | Vol. Solvent ml | Iron Filings grams[9] | Percent Total Removal |
|---|---|---|---|---|---|
| A | 1 | Benzene | 5.0 | 2.02 | 5.2 |
| | 2 | Benzene + 1200 ppm Ca-45[1] | 5.0 | 2.02 | 16.4 |
| | 3 | Regular Gasoline | 5.0 | 2.01 | 52.4 |
| | 4 | Reg. Gasoline[2] + 20 v/o isopropyl alcohol[3] | 5.0 | 2.03 | 54.1 |
| | 5 | Reg. Gasoline[2] + 1 v/o EDA[4] | 5.0 | 2.01 | 70.9 |

TABLE IV-continued

| Test Series | No. | Wash Solvent | Vol. Solvent ml | Iron Filings grams[9] | Percent Total Removal |
|---|---|---|---|---|---|
| | 6 | Reg. Gasoline[2] + 50 v/o Isopropanol | 5.0 | 2.01 | 41.5 |
| | 7 | Reg. Gasoline[2] + 1200 ppm Ca-45[1] | 5.0 | 2.00 | 50.3 |
| B | 1 | Reg. Gasoline[2] + v/o EDA[4] | 5.0 | 2.01 | 52.0 |
| | 2 | Reg. Gasoline[2] + 500 ppm Reaction product[5] | 5.0 | 2.05 | 54.1 |
| | 3 | JP-4[11] | 5.0 | 2.03 | 4.0 |
| | 4 | Water | 5.0 | 2.01 | 4.2 |
| | 5 | Water + 1 w/o NaOH | 5.0 | 2.00 | 8.6 |
| | 6 | Reg. Gasoline[2] + Isopropanol + Ethanolamine 10-2-1[5] | 5.0 | 2.00 | 76.3 |
| | 7 | Reg. Gasoline[2] + Isopropanol + EDA 10-2-1[5] | 5.0 | 2.01 | 75.5 |
| | 8 | Reg. Gasoline[2] + Isopropanol + Ethanolamine + Reaction product[5] 10-1.0-0.5 – 250 ppm[7] | 5.0 | 2.00 | 71.7 |
| | 9 | Reg. Gasoline[2] + Isopropanol + EDA + Reaction product[5] 10-1-0.5 – ppm[7] | 5.0 | 2.00 | 89.8 |
| C | 1 | Unleaded gasoline[12] + 2.5 v/o Isopropanol + 1 v/o EDA[3] + 100 ppm Reaction product[5] | 10 | 2.03 | 72.9 |
| | 2 | Reg. Gasoline[2] | 10 | 2.00 | 52.0 |
| | 3 | Unleaded Gasoline[12] | 10 | 2.00 | 4.4 |
| | 4 | Reforming Naphtha | 10 | 2.00 | 3.1 |
| | 5 | Hexane, Refinery | 10 | 2.00 | 3.4 |
| D | 1 | Refinery Hexane + 15 v/o Aromatic[7] | 10 | 2.00 | 5.4 |
| | 2 | Toluene | 10 | 2.00 | 7.4 |
| | 3 | Xylene | 10 | 2.00 | 8.0 |
| | 4 | Regular Gasoline[2] | 10 | 2.01 | 45.0 |
| | 5 | Unleaded Gasoline[12] | 10 | 2.00 | 6.5 |
| | 6 | Unleaded Gasoline + 0.5 v/o Ethylbromide | 10 | 2.04 | 5.7 |
| | 7 | Decane + Isooctane (1–1) + TEL[9] | 10 | 2.00 | 1.1 |
| | 8 | Unleaded Gasoline[12] + 2 v/o Isopropanol | 10 | 2.00 | 1.5 |
| | 9 | Unleaded Gasoline[12] + 2 v/o Acetone | 10 | 2.00 | 9.9 |
| | 10 | Unleaded Gasoline[12] + 2 v/o Isopropanol + 100 ppm Reaction product[5] | 10 | 2.01 | 44.4 |
| | 11 | Unleaded Gasoline[12] + 2 v/o Isopropanol + 1 v/o EDA[3] + 100 ppm Reaction product[5] | 10 | 2.01 | 65.0 |
| | 12 | 1-Hexene | 10 | 2.01 | 4.1 |
| | 13 | Reformer Naphtha + 50 ppm Lubrizol 573A | 10 | 2.00 | 13.5 |
| | 14 | Reformer Naphtha + 100 ppm reaction product[5] | 10 | 2.03 | 38.2 |
| | 15 | Reformer Naphtha + 1 v/o EDA[3] | 10 | 2.01 | 61.2 |
| E | 1 | Reformer Naphtha + 250 ppm Lubrizol 573A | 10 | 2.02 | 21.4 |
| | 2 | Reformer Naphtha + 250 ppm Lubrizol 573A 250 ppm Reaction product[5] | 10 | 2.00 | 49.2 |
| | 3 | Repeat-Reformer Naphtha + 250 ppm Lubrizol 573A + 250 ppm Reaction product[5] | 10 | 2.00 | 46.0 |
| | 4 | Reformer Naphtha + 250 ppm Lubrizol 573A + 250 ppm Reaction product[5] + 1 v/o EDA[3] | 10 | 2.00 | 61.8 |
| | 5 | Reformer Naphtha + 200 ppm Lubrizol 573A + 250 ppm Reaction product[5] + 0.1 v/o EDA[3] | 10 | 2.00 | 63.3 |
| | 6 | Reformer Naphtha + 250 ppm Lubrizol 573A + 250 ppm Reaction product[5] | 10 | 2.00 | 46.5 |
| F | 1 | Unleaded Gasoline[12] + ppm Lubrizol 573A + 250 ppm Reaction product[5] 750 ppm isopropanol + 250 ppm EDA[3] | 10 | 2.00 | 65.2 |

[1]An organic hydrocarbon oil containing 45 weight percent calcium sulfonate and having a base number of 20.
[2]Regular leaded gasoline as described in Example 1 but containing in addition about 30 ppm Lubrizol 573A.
[3]V/O denotes volume percent throughout Table IV.
[4]EDA is ethylenediamine — $H_2NCH_2CH_2NH_2$
[5]Reaction product as defined in Example I.
[6]10-2-1 denotes the volume ratio of the components respectively.
[7]10-1.0-0.5 - 250 ppm denotes the volume ratios of the components respectively.
[8]Mixture of equal parts of benzene, toluene and xylene.
[9]Tetraethyl lead.
[10]Iron filings of 40 mesh size manufactured by Mallinckrodt Chemical Works, St. Louis, Missouri, treated with titrated reaction product in sour condensate at an activity level of $596 \times 10^3$ dpm per gram.
[11]JP-4 is jet fuel.
[12]The unleaded gasoline used contained no additives.

It is clear that paraffinic materials are preferable to aromatic materials. In particular, it will be noted that benzene, toluene, xylene, and combinations thereof were poor solvents.

It is submitted that the foregoing examples clearly demonstrate the effectiveness of applicants' claimed method in preventing sulfur contamination due to sulfur, sulfur-containing compounds, and the like of refined products transported in a pipeline used for the transportation of sour hydrocarbon fluids.

Having thus described the invention, we claim:

1. A method for minimizing sulfur contamination of sweet hydrocarbon fluids transported in a pipeline for the transportation of sweet and sour hydrocarbon fluids said method consisting essentially of:

a. transporting a sour hydrocarbon fluid containing from 0 to about 2000 ppm of a corrosion inhibiting additive through said pipeline and thereafter;

b. transporting a sweet hydrocarbon wash solution containing from about 10 to about 2000 ppm of a mixture of amines consisting essentially of light amines having a molecular weight from about 31 to 150 and heavy amines having a molecular weight from 151 to about 500 wherein the molar ratio of said light amine to said heavy amine varies from about 10:1 to about 1:10; from 0 to about 2000 ppm of a corrosion inhibiting additive; from 0 to about 500 ppm of a surfactant and from 0 to about 1500 ppm of an alkanol containing from 1 to about 6 carbon atoms in an amount sufficient to provide a wash solution contact time with the interior pipeline surfaces of at least about 1 minute and, thereafter;

c. transporting said sweet hydrocarbon fluids containing from 0 to about 200 ppm of a corrosion inhibiting additive, said mixture of amines or mixtures of said additive and said mixture of amines through said pipeline.

2. The method of claim 1 wherein said additive is the reaction product formed by reacting one molar equivalent of an amine having a molecular weight from about 150 to about 500 and from about 0.1 to about 0.6 equivalents of an organic hydroxy acid, said acid having an ionization constant of at least about $1 \times 10^{-5}$.

3. The method of claim 1 wherein said wash solution contains from about 20 to 500 ppm of said mixture.

4. The method of claim 1 wherein said contact time is from 5 to 60 minutes.

5. The method of claim 4 wherein said wash solution contains from 10 to 200 ppm of said additive.

6. The method of claim 5 wherein said wash solution contains from about 5 to 250 ppm of said surfactant material.

7. The method of claim 6 wherein said alkanol is present in an amount equal to from 25 to 250 ppm.

8. The method of claim 7 wherein said contact time is from 10 to 30 minutes.

9. The method of claim 1 wherein said additive is mixed with said sour hydrocarbon fluid in an amount equal to from 20 to 200 ppm.

10. The method of claim 1 wherein said additive is contained in said sweet hydrocarbon fluid transported through said pipeline during the 24 hour period following the transportation of said wash solution in an amount equal to from 5 to 100 ppm.

11. The method of claim 10 wherein said time period is from 6 to 24 hours and said additive is present in an amount equal to from 10 to 20 ppm.

12. The method of claim 1 wherein said sweet hydrocarbon fluid transported through said pipeline during the 24 hour period following the transportation of said wash solution contains from about 5 to about 100 ppm of an amine having a molecular weight from about 31 to about 500.

13. The method of claim 12 wherein said sweet hydrocarbon contains at least about 2 ppm of said additive and wherein the total of said additive and said amine is from about 5 to about 100 ppm.

14. A method for removing sulfur and sulfur-containing compounds from surfaces contaminated with sulfur and sulfur-containing compounds by contacting said surfaces with a sweet hydrocarbon wash solution containing from 10 to 2000 ppm of a mixture of amines consisting essentially of light amines having a molecular weight from about 31 to 150 and heavy amines having a molecular weight from 151 to about 500 wherein the molar ratio of said light amine to said heavy amine varies from about 10:1 to about 1:10, from 0 to 2000 ppm of a corrosion inhibiting additive, from 0 to 500 ppm of a surfactant and from 0 to 1500 ppm of an alkanol containing from 2 to 6 carbon atoms in an amount sufficient to provide a wash solution contact time with said surfaces of at least 1 minute.

* * * * *